US005402159A

United States Patent [19]

Takahashi et al.

[11] Patent Number: 5,402,159

[45] Date of Patent: Mar. 28, 1995

[54] PIEZOELECTRIC INK JET PRINTER USING LAMINATED PIEZOELECTRIC ACTUATOR

[75] Inventors: Yoshikazu Takahashi; Masahiko Suzuki, both of Aichi, Japan

[73] Assignee: Brother Kogyo Kabushiki Kaisha, Aichi, Japan

[21] Appl. No.: 886,332

[22] Filed: May 20, 1992

Related U.S. Application Data

[63] Continuation-in-part of Ser. No. 673,148, Mar. 21, 1991, abandoned.

[30] Foreign Application Priority Data

| | | | |
|---|---|---|---|
| Mar. 26, 1990 | [JP] | Japan | 2-75858 |
| May 20, 1991 | [JP] | Japan | 3-114652 |
| May 20, 1991 | [JP] | Japan | 3-114653 |
| May 20, 1991 | [JP] | Japan | 3-114654 |
| Jul. 18, 1991 | [JP] | Japan | 3-178051 |

[51] Int. Cl.[6] ..... B41J 2/045

[52] U.S. Cl. ..... 347/9; 310/317; 310/366; 347/13; 347/72

[58] Field of Search ..... 346/140 R; 310/328, 310/330, 365, 366, 317, 316; B41J 3/04; 347/9, 13, 14, 72

[56] References Cited

U.S. PATENT DOCUMENTS

| | | | |
|---|---|---|---|
| 4,436,439 | 3/1984 | Koto | 346/140 R X |
| 4,523,121 | 6/1985 | Takahashi et al. | 310/365 X |
| 4,639,735 | 1/1987 | Yamamoto et al. | 346/140 R X |
| 4,639,747 | 1/1987 | Sakurada et al. | 346/140 R |
| 4,812,698 | 3/1989 | Chida et al. | 310/366 X |
| 4,825,227 | 4/1989 | Fischbeck et al. | 346/140 R X |
| 4,833,359 | 5/1989 | Tanoue et al. | 310/316 |
| 5,086,308 | 2/1992 | Takahashi et al. | 346/140 R |
| 5,128,694 | 7/1992 | Kanayama | 346/140 R |

FOREIGN PATENT DOCUMENTS

| | | |
|---|---|---|
| 58-102776 | 6/1983 | Japan . |
| 60-090770 | 5/1985 | Japan . |

*Primary Examiner*—Benjamin R Fuller
*Assistant Examiner*—Alrick Bobb
*Attorney, Agent, or Firm*—Kane, Dalsimer, Sullivan, Kurucz, Levy, Eisele and Richard

[57] ABSTRACT

A head for a piezoelectric ink jet printer includes a plurality of ejector devices for ejecting ink droplets. Each ejector device has an ink channel body defining an ink channel. The head further includes a piezoelectric actuator secured to the ink channel for actuating the ejector devices. The actuator is made up of a plurality of piezoelectric ceramic layers, a plurality of internal positive electrode layers, and a plurality of internal negative electrode layers, which are laminated in such a manner that each piezoelectric ceramic layer is sandwitched between each internal positive electrode layer and each internal negative electrode layer. At least one of the internal positive electrode layers and the internal negative electrode layers are divided into a plurality of segments so as to be provided in association with respective ones of the plurality of ejector devices. To provide a head which is simple in construction and easy to manufacture, yet capable of printing high resolution image with reduced power source voltage, the ink channel is configured to have a width larger than widths of the corresponding segmental electrode layers. The piezoelectric actuator may further include a deformation restraining member for restraining deformation of the piezoelectric actuator, whereby a low voltage driving of the head can be accomplished.

14 Claims, 14 Drawing Sheets

PIEZOELECTRIC INK JET PRINTER USING LAMINATED PIEZOELECTRIC ACTUATOR

CROSS-REFERENCE TO RELATED APPLICATION

This application is a continuation-in-part of application Ser. No. 07/673,148, filed Mar. 21, 1991, now abandoned.

BACKGROUND OF THE INVENTION

1. Field of the Invention

The present invention relates to a piezoelectric ink jet printer, and more particularly to a printing head for such a printer wherein a laminated piezoelectric device is used as a piezoelectric actuator.

2. Description of the Related Art

A piezoelectric ink jet printing head has recently been proposed in the art. The head is primarily comprised of an ejection device and a piezoelectric actuator. The ejection device has an ink chamber whose volume is changed depending on the displacement of the piezoelectric actuator. In a printer known as a drop-on-demand type, when the volume of the ink chamber is reduced, ink contained in the ink chamber is ejected through a valve defining the ink chamber whereas when the volume of the ink chamber is increased, ink is supplemented into the ink chamber through another valve which also defines the ink chamber. A multiplicity of the ejection devices are closely juxtaposed so that a desired character or image is formed by ejecting ink droplets from selected ejection devices.

A conventional drop-on-demand printer head uses a single piezoelectric actuator for a single ejection device. Although it is desirable to include a number of ejection devices in the printer head so as to be capable of printing over an extensive area with high resolution, there have been difficulties in so doing in the conventional head structure. Partly because the structure of the head becomes complicated, and partly because the manufacture of the head becomes intricate, thus the manufacture of the head becomes costly due to a large number of manufacturing steps involved. Further, the dimension of the piezoelectric actuator cannot be made so small due to machining reasons.

To solve such problems, applicants have proposed an improved printer head using a piezoelectric actuator of a laminated structure as disclosed in U.S. application Ser. No. 07/673,148 filed Mar. 21, 1991, abandoned. In the laminated structure, piezoelectric ceramic layers and internal electrode layers are alternately arranged one on the other. At least one of the internal positive electrode layers and the internal negative electrode layers, both constituting the internal electrode layers, is divided into a plurality of segments so as to be provided in one-to-one correspondence to the respective ones of the ejection device, whereby a high resolution, low-voltage driven printer head can be provided which is simple in structure and inexpensive in cost.

The printer head using a laminated piezoelectric actuator (LPA) 38 is shown in FIG. 1. As shown, the LPA 38 is formed with three piezoelectric active regions 46*a*, 46*b*, 46*c* and four piezoelectric inactive regions 48. An ink channel body 34 is secured to the LPA 38 at the piezoelectric inactive regions 48. An orifice plate 36 formed with orifices 37*a*, 37*b*, 37*c* is secured to the opposite side of the ink channel body 34. When a driving voltage is applied between an external negative electrode 52 and an external positive electrode 54*a*, the piezoelectric active region 46*a* is deformed in the direction of its thickness as shown. The volume of the associated ink channel 32 is thereby reduced and thus an ink droplet is ejected from the orifice 37*a*. The LPA 38 is provided for a plurality of ejection devices 70*a*, 70*b*, 70*c*. Since the LPA 38 is made up of a reduced number of components, its structure is relatively simple. Further, due to the use of LPA 38 having segmental internal electrodes, the device can be driven at a low voltage, yet capable of printing with high resolution.

In the laminated piezoelectric structure as described, there is a problem that an amount of displacement of the piezoelectric active region is adversely reduced if the active region is widened intending to drive it with a lower driving voltage. In order to have the same amount of displacement while widening the active region, the driving voltage must be increased. Further, since the piezoelectric active region displaces the same amount toward not only the ink channel but also its opposite direction, the ejection of the ink droplet is performed with a half of full energy.

In the printer head of the type described above, the LPA 38 is extended pursuant to a longitudinal effect. The displacement $\times$ of the LPA 38 is represented by the following equation:

$$x=(d_{33}\times V)\times n$$

where $d_{33}$ is a piezoelectric constant pursuant to the longitudinal effect, V is a driving voltage, and n is the number of laminated layers. As can be appreciated from the above equation, if the number n of the laminated layers is increased, the required driving voltage to attain a desired amount of displacement can be reduced and hence a low-voltage driven piezoelectric ink jet printer head can be provided. However, in order to make the printer head compact, the thickness of the LPA 38 needs to be reduced. In order to increase the number of laminated layers and to reduce the thickness of the LPA 38, it is absolutely necessary to reduce the thickness of each layer of the LPA 38. An electrostatic capacity C of the LPA 38 is represented by:

$$C=\epsilon\cdot S/t$$

where $\epsilon$ is a dielectric constant, S is an entire area of the internal electrode, and t is the thickness of each piezoelectric layer. As is apparent from the above relation, the electrostatic capacity of the LPA 38 increases as the number of laminated layers increases and as the thickness of the piezoelectric layer becomes thinner. While it is theoretically possible to drive the piezoelectric ink jet printer head at a low voltage, say several volts, if the thickness of one layer is made thinner and the number of laminated layers is increased, it is required that extremely high-level current be instantaneously flowed to instantaneously deform the LPA 38 due to an extremely large electrostatic capacitance. In the piezoelectric ink jet printer head, the ink droplet is generally ejected at a time when the increased volume of the ink chamber is restored. Although it is possible to control the instantaneously flowed current by delaying the rising time of the voltage across the piezoelectric layer or by the use of an LC resonance circuit, it is necessary that the change of the pressure in the ink chamber instantaneously occur. The deformation of the LPA or the discharge of the LPA 38 must occur within several microseconds. As such, an expensive discharge circuit is required due to the fact that the maximum instantaneous current at the time of discharge is extremely large.

An electrostatic capacitance of one piezoelectric driving portion is about 35 nF. The volume change of the ink chamber necessary for ejecting ink droplets is about $3.37\times10^{-4}$ mm$^3$, and a driving voltage to achieve the necessary volume change of the ink chamber is about 20 volts. According to a conventional driving sequence, a pulse voltage of minus 20 volts is applied across the piezoelectric layer so that the voltage thereacross reaches minus 20 volts within a duration of 3 μsec to thus deform the piezoelectric element, and the same voltage is further applied thereacross for a duration of another 10 μsec. Thereafter, the piezoelectric layer is subjected to discharge within a duration of 2 μsec so as to be restored to the original state. The head is driven at a frequency of 10 kHz at maximum while taking print quality into consideration. The printing period of the head is thus 100 μsec at the shortest. According to the above-described driving sequence, it is required that an extremely large instantaneous current such that its maximum level is about minus 470 mA flowed into the piezoelectric layer in order to increase the voltage across the 35 nF piezoelectric element up to minus 20 V within a duration of 3 σsec. If 64 driving portions in the piezoelectric actuator are simultaneously driven, a current whose maximum level is about minus 30 amperes needs to be instantaneously supplied. Hence, there is a problem that a power source having a capability of supplying 600 VA power needs to be provided for driving the head.

In actuality, however, It is extremely rare that 64 driving portions are simultaneously driven to eject ink droplets from the 64 orifices at a time, thus the provision of such a large power source is redundant. Nevertheless, such a large power source is provided. Consequently, due to the presence of the large power source, the size of the ink jet printer head cannot be made compact and the cost of the printer head is increased.

SUMMARY OF THE INVENTION

The present invention has been made to solve the above problems, and accordingly it is an object of the invention to provide a piezoelectric ink jet printer head which is simple in structure, inexpensive in cost, and driven at a low voltage, yet capable of printing at high resolution.

Another object of the invention is to provide a piezoelectric ink jet printer head which reduces a maximum instantaneous current at the time of discharging or at the time of ink droplet ejection and is driven by a low driving voltage such as several tens volts.

To achieve the above and other objects, there provided a printing head for a piezoelectric ink jet printer, which includes a plurality of ejector devices and a piezoelectric actuator. The plurality of ejector devices are juxtaposed along a line extending in a first direction for ejecting ink droplets in a second direction perpendicular to the first direction. Each ejector device has an ink channel body defining an ink channel. The piezoelectric actuator is secured to the ink channel bodies of the ejector devices for actuating each of the ejector devices by changing the inner volume of the associated ink channel independently of one another. The actuator is made up of (1) a plurality of piezoelectric ceramic layers, (2) a plurality of internal positive electrode layers, and (3) a plurality of internal negative electrode layers. These layers (1), (2) and (3) are laminated in such a manner that each piezoelectric ceramic layer is sandwitched between each internal positive electrode layer and each internal negative electrode layer. At least one of the internal positive electrode layers and the internal negative electrode layers are divided into a plurality of segments so as to be provided in a one to one association with respective ones of the plurality of ejector devices.

In accordance with one aspect of the present invention, the ink channel has a width in the first direction larger than widths of the associated segmental electrode layers in the first direction.

In accordance with another aspect of the present invention, a deformation restraining member is further provided in the piezoelectric actuator for restraining deformation of the piezoelectric actuator which may otherwise deform in a direction opposite to the second direction when a voltage is applied between the positive and negative electrode layers.

In accordance with still another aspect of the present invention, the thickness of each piezoelectric ceramic layer is set to fall in a range of from 40 μm to 150 μm.

in accordance with yet another aspect of the present invention, an electrical circuit is provided in connection with the printing head, which includes an oscillator for producing a driving signal having a predetermined frequency, frequency diving means for frequency-dividing the driving signal to produce at least two sets of frequency-divided driving signals, and a plurality of driving means provided corresponding to a number of sets of frequency-divided driving signals, for sequentially driving the active regions on a group basis in accordance with each of the frequency-divided driving signals at a given timing within a time defined by a printing period. The plurality of active regions are divided into a plurality of groups corresponding to the plurality of driving means.

Preferably, each of the plurality of driving means comprises pulse detection means for detecting a predetermined frequency-divided signal produced from the frequency dividing means, time setting means for setting times for charging and discharging the corresponding piezoelectric ceramic layer in accordance with the frequency-divided signal detected by the detection means, first switching means for charging the piezoelectric ceramic layer during a period of charging time set by the time setting means, and second switching means for discharging the piezoelectric ceramic layer during a period of discharging time set by the time setting means.

Each of these features of the present invention can be used independently of others and certain features may be used in combination.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
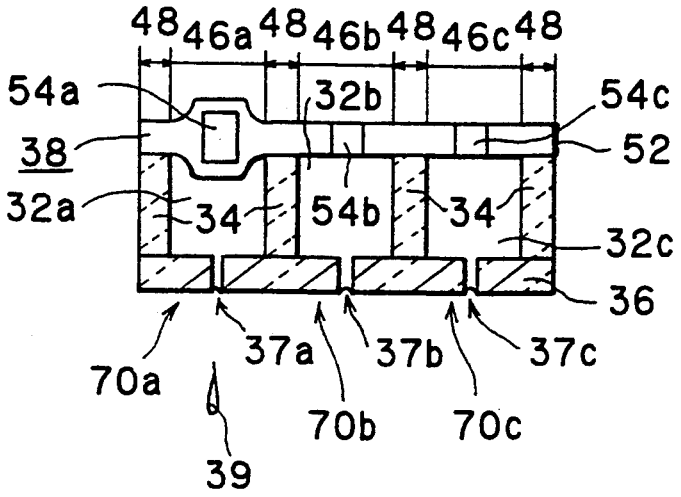
FIG. 1 is a cross-sectional view partially showing a droplet ejection earlier proposed by the same applicants.

A first embodiment of the present invention will be described with reference to FIGS. 2 through 7, The same reference numerals used in FIG. 1 will be used throughout the figures to denote the same or corresponding components.

Figure 2:
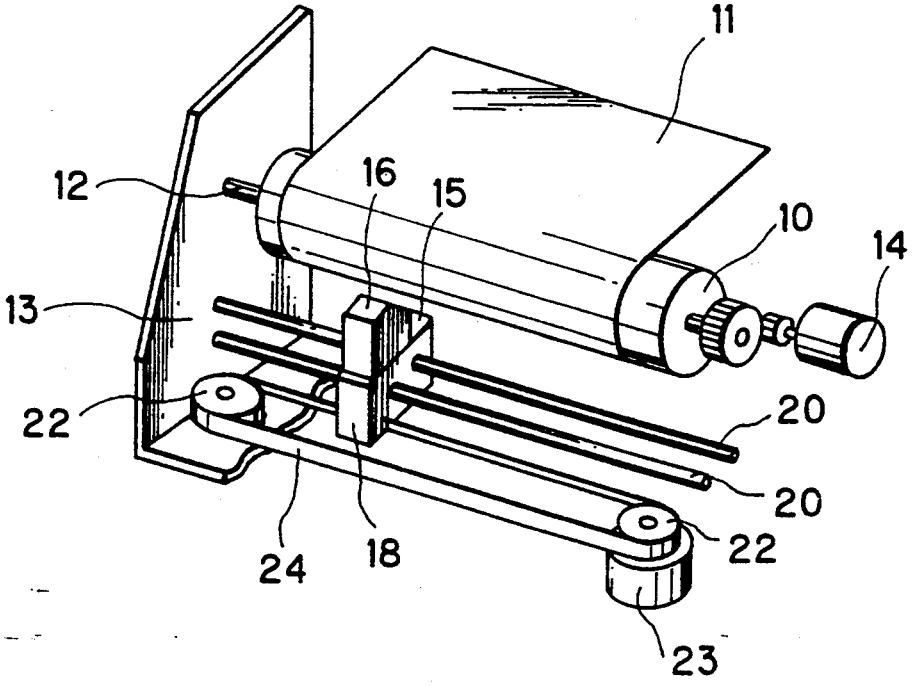
FIG. 2 is a perspective view showing an ink jet printer according to the present invention.

FIG. 2 shows a primary portion of an ink jet printer. A sheet of paper 11 is supported on a platen 10 to be incrementally moved in accordance with rotations of the platen 10 which is rotatably supported on side frames 13 by virtue of a shaft 12. The platen 10 is rotated by a motor 14 through a gear train. A piezoelectric ink jet head 15 is disposed in confrontation with the peripheral surface of the platen 10. The head 15 is mounted on a carriage 18 together with an ink reservoir 16. The carriage 18 is slidable movably supported on two guide rods 20 extending in a direction parallel to the longitudinal axis of the platen 10. An endless timing belt 24 which is circulatingly movably stretched between a pair of spaced pulleys 22 is connected to the carriage 18. A counterpart of the pulleys 22 is driven by a reversible motor 23 to bi-directionally circulate the timing belt 24, whereby the carriage 18 is moved back and forth along the platen 10.

Figure 3:
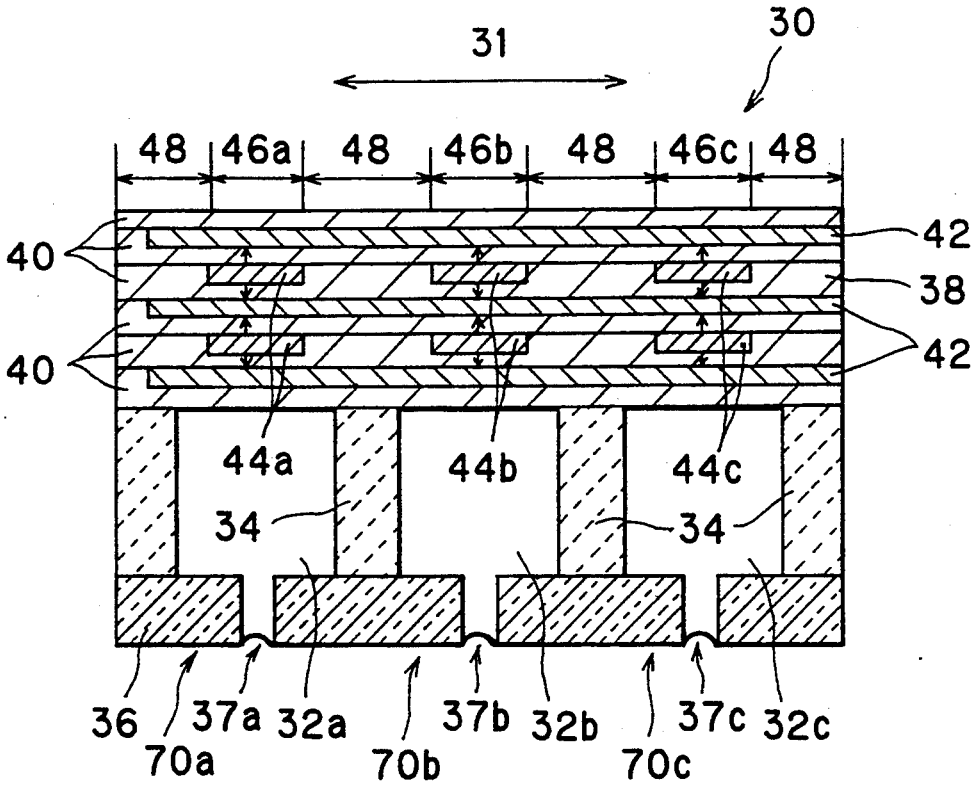
FIG. 3 is a cross-sectional view showing an ejector array of the piezoelectric head according to a first embodiment of the present invention.

FIG. 3 is a cross-sectional view showing an ejector array 30 used in the piezoelectric ink jet head 15. The ejector array 30 is made up of an ink channel body 34, a laminated piezoelectric actuator (LPA) 38 fixedly secured to one side of the ink channel body 34, and an orifice plate 36 fixedly secured to another side of the ink channel body 34. The ink channel body 34 is formed with three ink channels 32*a*, 32*b*, 32*c* serving in its entirety as an ink chamber. Each ink channel is 1.2 mm width in the planar direction of the array 38 denoted by numeral "31", and 15 mm length in the direction perpendicular to the sheet of drawing. The orifice plate 36 is formed with orifices 37*a*, 37*b*, 37*c* which are in fluid communication with the respective ink channels 32*a*, 32*b*, 32*c*.

The LPA 38 is a lamination made up of piezoelectric ceramic layers 40 which are piezoelectric/electrostrictive in nature, internal negative electrode layers 42, and internal positive electrode layer segments 44*a*, 44*b*, 44*c* aligned with the ink channels 32*a*, 32*b*, 32*c*, respectively. Each of the internal positive electrode layer segments 44*a*, 44*b*, 44*c* is 1.0 mm width in the planar direction 31. The thickness of the LPA 38 is about 0.5 mm. The LPA 38 has piezoelectric active regions 46*a*, 46*b*, 46*c* sandwitched between the internal negative electrode layers 42 and the internal positive electrode layer segments 44*a*, 44*b*, 44*c*. The LPA 38 also has piezoelectric inactive regions 48 which are not sandwitched between two internal electrode layers. The width of the piezoelectric active regions 46*a*, 46*b*, 46*c* in the planar direction is 1.0 mm. Each piezoelectric ceramic layer 40 has a thickness of 40 μm and is formed of ceramic material of lead zirconate titanate (PZT) group which has ferroelectricity. The active regions 46*a*, 46*b*, 46*c* of each piezoelectric ceramic layer 40 are polarized in advance in the lamination direction. Arrows denoted in the respective active regions 46*a*, 46*b*, 46*c* denote polarizing directions. Each of the positive and negative electrodes is formed of metals of Ag—Pd group and has a thickness of about 2 μm. The LPA 38 is fixedly secured to the channel body 34 at the center portion of each of four piezoelectrically inactive regions 48.

Figure 6:
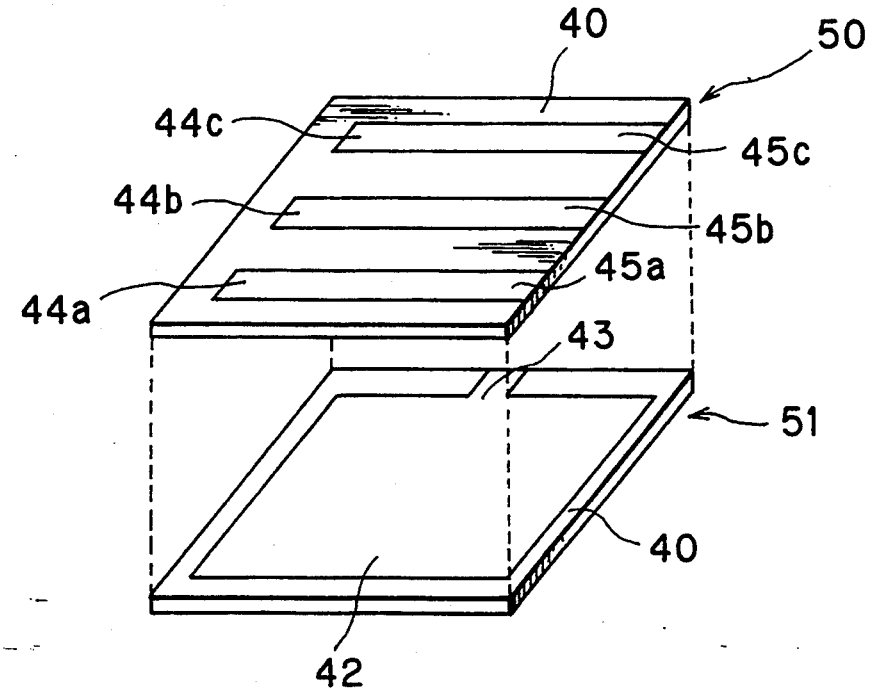
FIG. 6 is a perspective view showing a green sheet.

A manufacturing process of the LPA 38 thus arranged will be described with reference to FIG. 6.

As shown in the figure, a green sheet 50 is firstly formed on the upper surface of the piezoelectric ceramic layer 40 by way of screen printing so as to have three-segmental internal positive electrode layers 44*a*, 44*b*, 44*c* and associated electrode leads 45*a*, 45*b*, 44*c* which are provided in one-to-one correspondence with the ink channels 32*a*, 32*b*, 32*c*, respectively. Further, another green sheet 51 is formed on the upper surface of the piezoelectric ceramic layer 40 by way of screen printing so as to have the inner negative electrode layer 42 and its lead 43. These two types of green sheets 50, 51 are alternately laminated to have ten sheets in total. A third green sheet (not shown) is placed over the uppermost surface of the laminate sheets, which is not formed with an internal electrode layer on the upper surface of the piezoelectric ceramic layer 40. The laminated piezoelectric structure thus constructed are pressed while applying heat thereto and then the LPA 38 is obtained after defat and sintering treatments. External negative electrodes 52, and external positive electrodes 54a, 54b, 54c are bonded to the corresponding electrode leads 43, 45a, 45b, 45c of the LPA 38. The LPA 38 is then immersed into an oil bath filled with an insulation oil such as silicon oil heated to a temperature of about 130° C. and an electric field of 2.5 kV/mm is applied between the external negative electrode 52 and the external positive electrodes 54a, 54b, 54c to perform polarization. Through the above processes, the LPA 38 is obtained.

Figure 7:
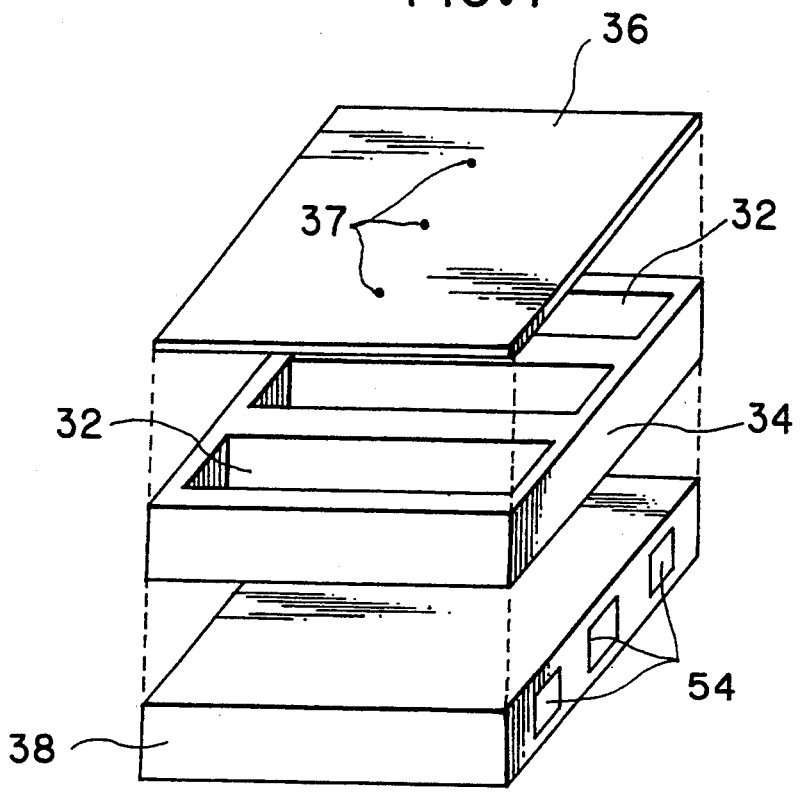
FIG. 7 is a perspective view showing assembling process of the ejector array.

As shown in FIG. 7, the ejector array 30 is provided by assembling the LPA 38, the channel body 34 having three ink channels 34 each being 1.2 mm width and 15 mm length, and the orifice plate 36 formed with three orifices 37.

Figure 4:
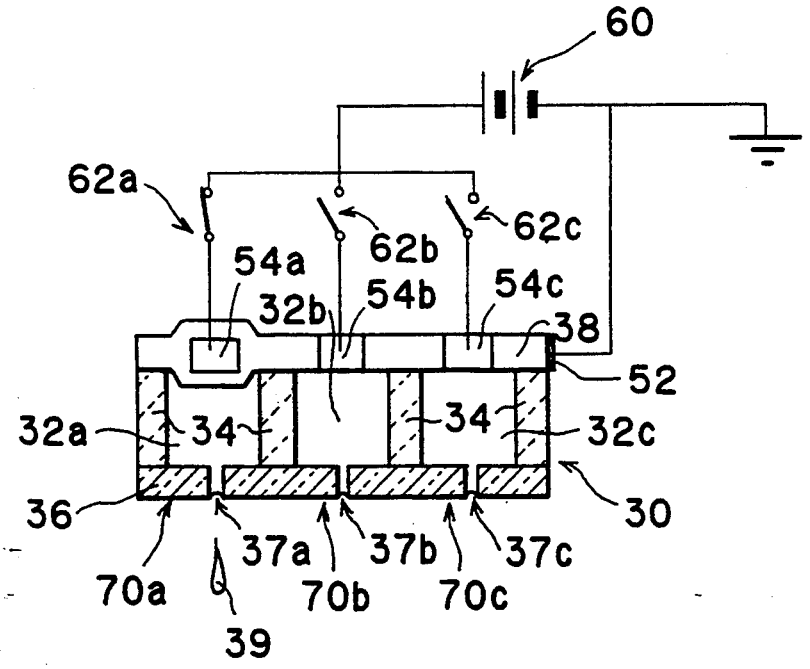
FIG. 4 is a diagram showing an electrical connection of the ejector array shown in FIG. 3.

The ejector array 30 is electrically connected as shown in FIG. 4. Both the negative terminal of a power source 60 and the external negative electrode 52 of the LPA 38 are grounded, and the positive terminal of the power source 60 is connected through Single-throw switches 62a, 62b, 62c to the external positive electrodes 54a, 54b, 54c, respectively. When these switches 62a, 62b, 62c are closed by a controller, a driving voltage from the power source 60 is applied between the internal negative electrode layer 42 and the internal positive electrode layer 44.

In operation, when, for example, the switch 62a is closed by the controller in accordance with print data, a voltage is applied between the internal negative electrode layer 42 and the internal positive electrode layer 44a, and a bias electric field is in turn developed across the piezoelectric ceramics layer 40 positioned between these two electrodes. As a consequence, the piezoelectric active region 46a is piezoelectrically electrostricted in the vertical direction caused by piezoelectric/electrostrictive longitudinal effect, whereby the volume of the ink channel 32a is reduced and thus ink in the ink channel 32a is ejected from the orifice 37a in the form of droplet. On the other hand, when the piezoelectric active region 46a is restored to the original position by the opening of the switch 62a, ink is supplemented from the ink supplying device 16 through a valve (not shown) in accordance with the increase of the volume of the ink channel 32a. When the different switch 62b is closed, an ink is ejected from the corresponding ink channel 32b.

The ejector array 30 of the first embodiment serves as three ejecting devices 70a, 70b, 70c of the piezoelectric ink jet printer head, and a single LPA 38 serves as piezoelectric actuators provided in association with the three ejecting devices 70a, 70b, 70c.

Figure 5:
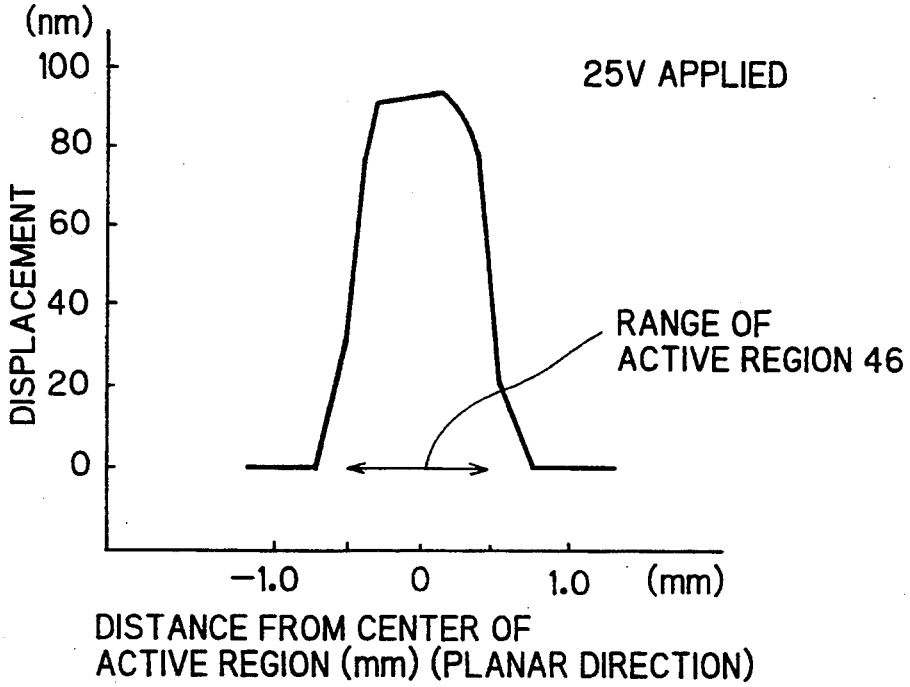
FIG. 5 is a diagram graphically showing a displacement of laminated piezoelectric actuator in relation to a distance from the center of a piezoelectric active region.

FIG. 5 shows measurements of displacement of the LPA 38 in the planar direction 31. As can be appreciated from the graph shown therein, the piezoelectric active region 46 displaces more than 90 nm when a voltage of 25 V is applied thereto whereas there is no substantial displacement in the inactive region 48. From this fact, it can be understood that in order to effectively deform the LPA 38 toward the ink channel 32, it is necessary that the width of the ink channel 32 in the direction planar direction 31 be larger than the width of the piezoelectric active region 46. In this embodiment, the width of the ink channel 32 in the planar direction 31 is set to 1.2 mm which is larger than the width of the active region 46. As a consequence, application of only 30 V suffices to eject ink droplets.

As described, in the piezoelectric ink jet printer in accordance with the first embodiment of the present invention, a single LPA 38 serves as a piezoelectric actuator for the three ejection devices 70a, 70b, 70c. Therefore, the structure of the ejector array 30 and thus the structure of the head 15 can be simplified, and hence the number of manufacturing steps can be reduced which in turn reduces the manufacturing cost. Since the piezoelectric actuator is in the form of a laminated piezoelectric structure and the width of the ink channel 32 is set to be larger than the width of the active region 46, the LPA 38 is deformed greatly with a reduced voltage. Further, the LPA 38 is provided with the internal electrode layers 42, 44 formed by way of screen printing, it is easy to shorten the widths of the piezoelectric active regions 46a, 46b, 46c and the piezoelectric inactive regions 48 to a greater extent. For example, by compacting the size of the ejector array 30 having three ejecting devices 70a, 70b, 70c, print resolution can be improved. As such, the printer head capable of printing over an extensive area with high resolution can be obtained.

Furthermore, The internal negative electrode layers 42 and the internal positive electrode layers 44 of the LPA 38 are not exteriorly exposed except the electrode leads 43, 45, so that there is no problem in terms of degradation of electrical insulation, and both durability and humidity proof are excellent.

Figure 8:
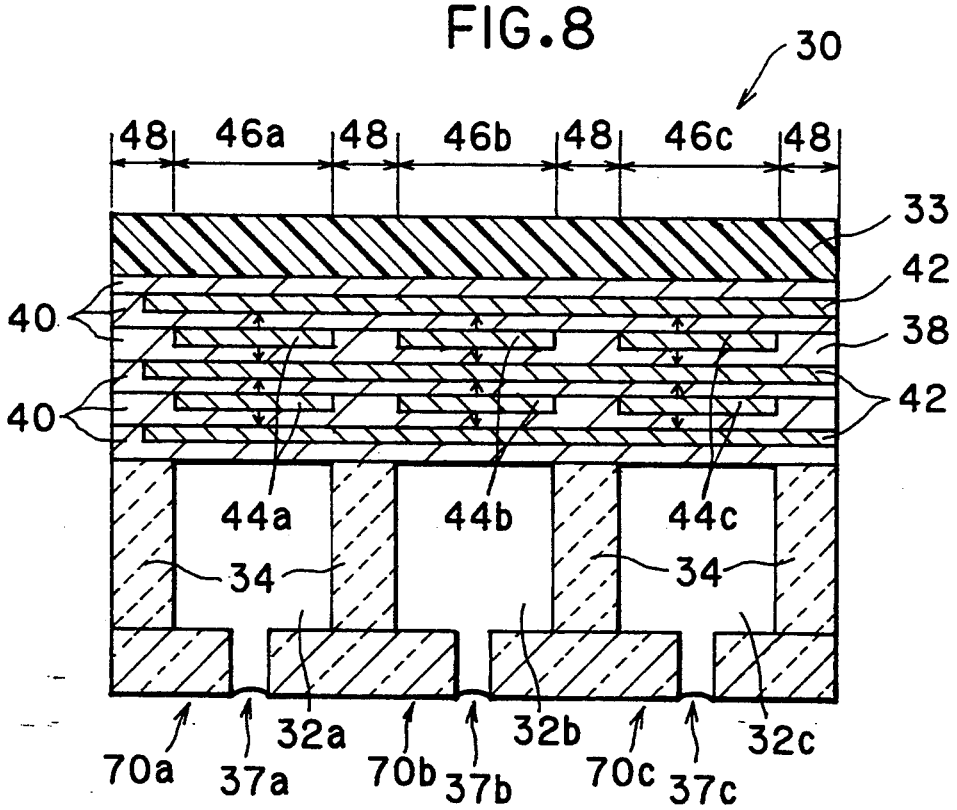
FIG. 8 is a cross-sectional view showing an ejector array of the piezoelectric head according to a second embodiment of the present invention.
Figure 9:
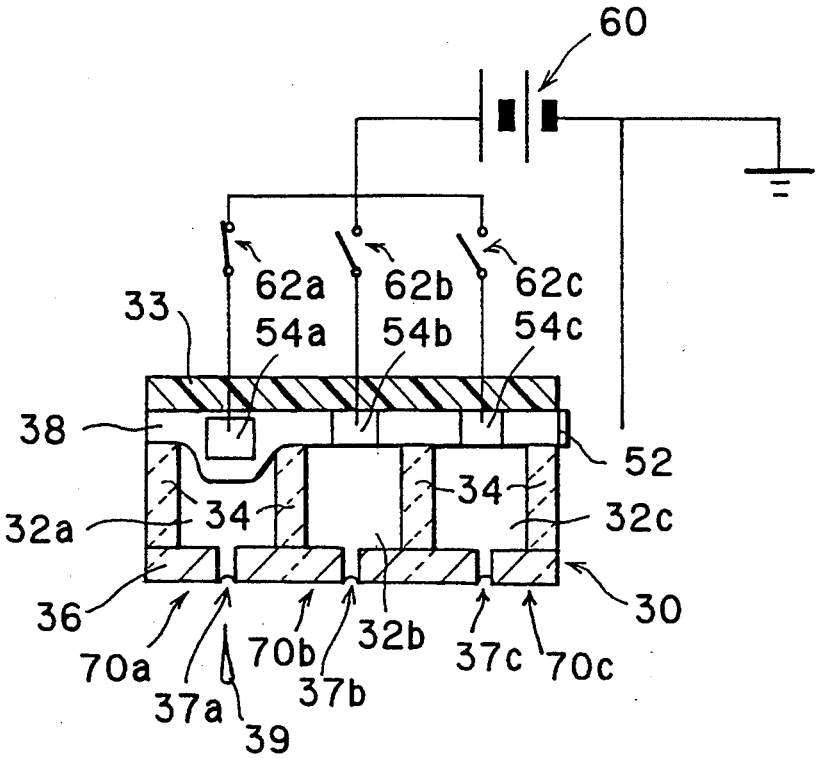
FIG. 9 is a diagram showing an electrical connection of the ejector array shown in FIG. 8.

A second embodiment of the present invention will be described with reference to FIGS. 8 through 10 which are similar to FIGS. 3 through 5, respectively, but differ in that the ejector array 30 is further made up of a deformation restraining member 33 in addition to an ink channel body 34, a laminated piezoelectric actuator (LPA) 38, and an orifice plate 36 as shown in FIG. 8. The deformation restraining member 33 is made of metals of high modulus of elasticity or ceramics. The ejector array 30 shown in FIG. 8 is electrically connected as shown in FIG. 9.

Figure 10:
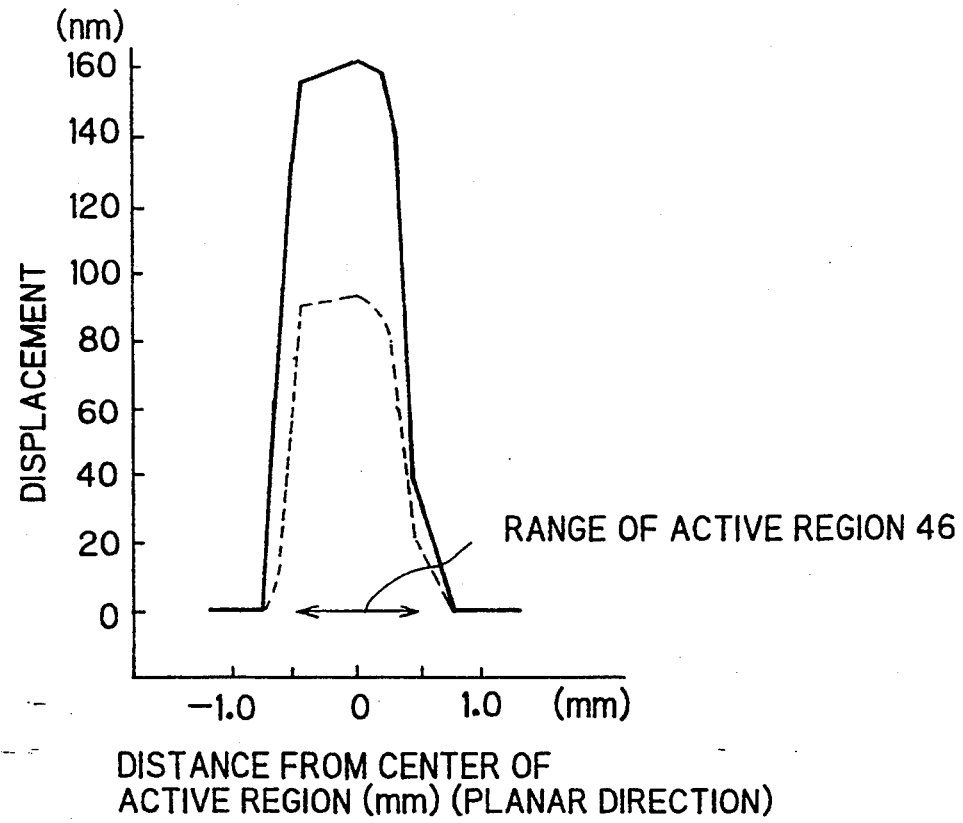
FIG. 10 is a diagram graphically showing a displacement of laminated piezoelectric actuator in relation to a distance from the center of a piezoelectric active region according to the second embodiment of the present invention.

FIG. 10 shows measurements of displacement of the LPA 38 in the planar direction of the ejector array 30. As shown, while in the case of no deformation restraining member 33, the piezoelectric active region 46 displaces about 90 nm when a voltage of 25 V is applied thereto, it displaces 160 nm under the same condition in the case where the deformation restraining member 33 is provided in accordance with the second embodiment. As can be appreciated, efficiency of the LPA 38 is improved 1.8 times as high as that of the LPA 38 which is not provided with the deformation restraining member 33. From the experimental results, it was found that only 17 volts driving voltage suffices for ejecting ink droplets with the head 15 of the present invention.

As described, with the provision of the deformation restraining member 33, displacement of the LPA 38 can be effectively carried out and the driving current can be largely decreased.

Various modifications of the first and second embodiments of the invention can be made. For example, while in the foregoing embodiments, a single laminated piezoelectric structure is used as a piezoelectric actuator in association with three ejector devices 70a, 70b, 70c, the piezoelectric actuator can be provided in association with a larger number of ejector devices if the internal positive electrode layer is divided into a larger number of segments.

In the embodiments described, the internal positive electrode layer 44 is divided into segments corresponding individually to the respective ones of the ink channels 32a, 32b, 32c, the internal negative electrode layer 42 may be similarly divided into segments while remaining the internal positive electrode,layer 44 undivided. Otherwise, both the internal positive and negative electrode layers may be divided into segments. That is, at least either one of the internal negative electrode layer or the internal positive electrode layer can be divided into segments to correspond to the respective ink channels 32*a*, 32*b*, 32*c*. In addition, the deformation restraining member 33 may not be a single plate but a plurality of such members may be provided in association with the piezoelectric active regions 46.

Moreover, the electric field can be applied to the piezoelectric active regions 46 in the direction opposite to the polarized direction so that the thickness of the active regions 46 is compressed. In such a case, insofar as the displacement of the LPA 38 at the side opposite the ink channel 32 is constrained, the similar effect can be obtained.

A third embodiment of the present invention will be described with reference to FIGS. 11 through 16.

Figure 11:
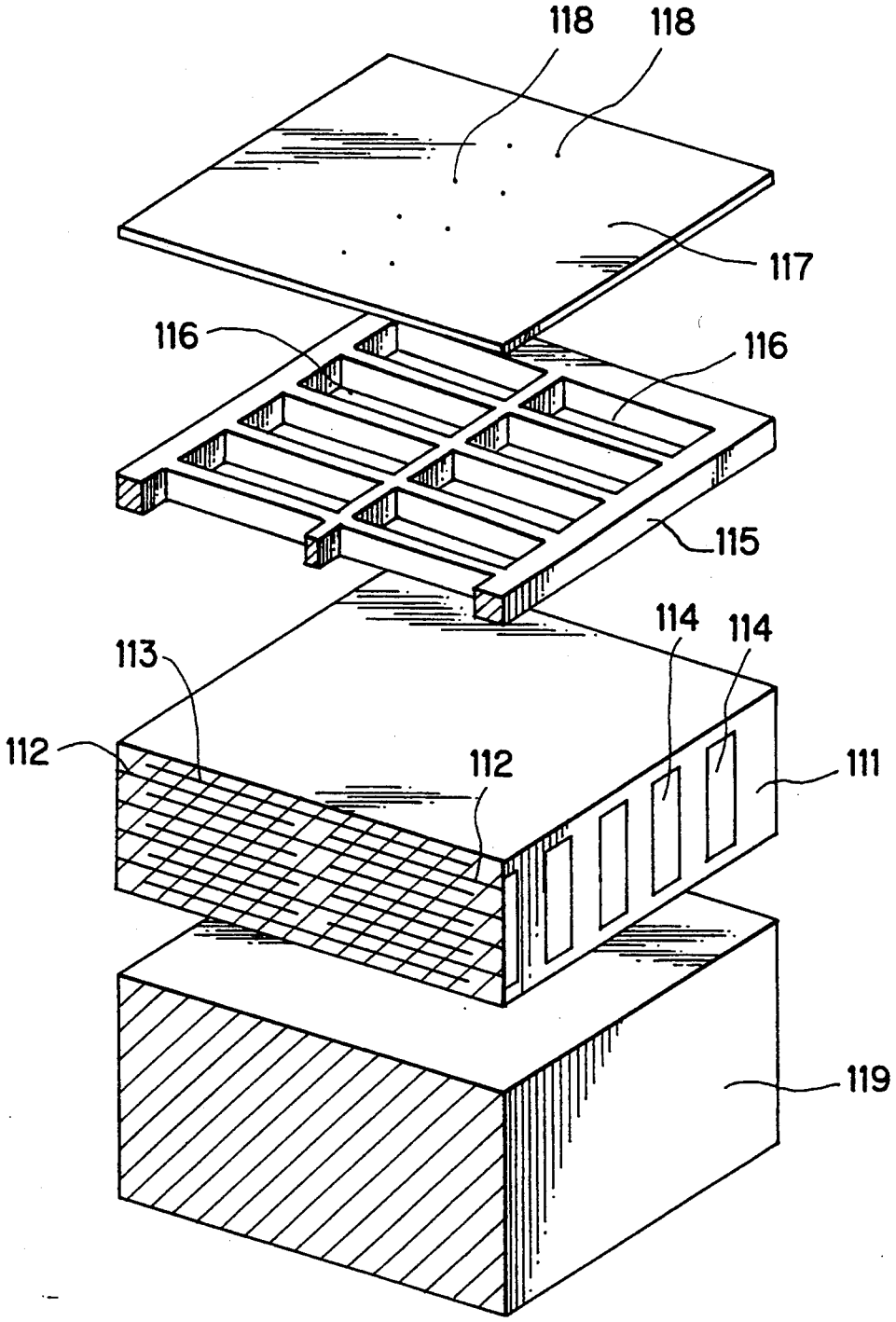
FIG. 11 is a perspective view showing an arrangement of a head for a piezoelectric ink jet printer according to a third embodiment of the present invention.
Figure 12:
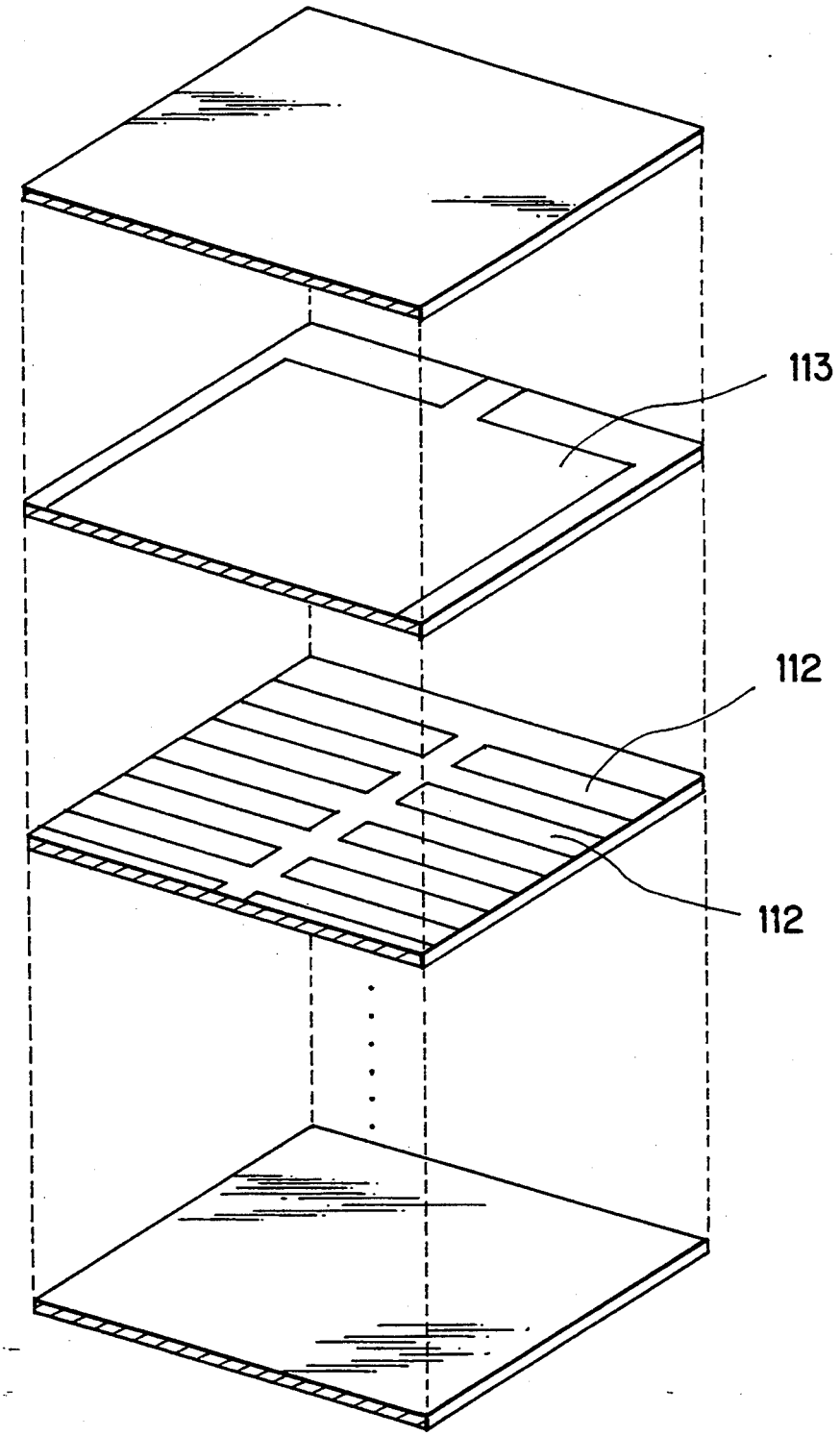
FIG. 12 is an explanatory diagram showing an arrangement of the head according to the third embodiment of the invention.

As shown in FIG. 11, the printer head is made up of a locally deformable laminated piezoelectric actuator (LPA) 111, an ink cavity plate 115, an ink nozzle plate 117, and a back plate 119, which are stacked as illustrated. FIG. 12 shows the arrangement of the LPA 111 which has an outer dimension of 14.4×68×0.5 mm. Five kinds of laminated piezoelectric structures are prepared using five different thickness piezoelectric ceramic layers whose thicknesses are 20, 40, 80, 120 and 160 μm. The piezoelectric ceramic layers have the same two-dimensional size of 14.4×68 mm. 64-divided internal electrodes 112, each being 1×6.7 mm, are formed on each of a half of the piezoelectric ceramic layers and a common internal electrode 113 of 13×66 mm is formed on each of another half of the piezoelectric ceramic layers. These two types of layers are alternately arranged one on the other to have a laminated structure, 32 outer electrodes 114 are formed on one side face of the laminated structure and another 32 outer electrodes 114 are formed on another side face of the laminated structure. Each side of the laminated structure is 68×0.5 mm in size. The 64 outer electrodes in both sides of the laminated structure are provided for connections to the 64-divided internal electrodes 112. Further, outer electrodes 14 for connections to the common internal electrodes 113 are formed on a side face of 14.4×0.5 mm.

The ink cavity plate 115 has an outer dimension of 14.4×68×0.1 mm and is formed with 64 ink cavities of 1.6×6.3×0.1 mm corresponding to the locally deformable driving portions. The ink nozzle plate 117 has an outer dimension of 14.4×68×0.1 mm and is formed with 64 ink ejection orifices so as to agree with the positions of ink cavities 116. The back plate 119 has an outer dimension of 14.4×68×1 mm and is fixedly bonded to the rear surface of the LPA 11 having a size of 14.4×68×1 mm.

The piezoelectric ceramic as used in this embodiment is of a lead zirconate titanate (PZT) group having a dielectric constant $\epsilon_s$ of about 3000, a piezoelectric constant $d_{33}$ ranging from about 450 to 500 pm/V, and a Curie temperature $T_c$ of about 300° C. Piezoelectric ceramic materials having a larger piezoelectric constant $d_{33}$ exist, however, such materials have generally larger dielectric constant and lower Curie temperatures. Therefore, such materials are not suitable for use in the locally deformable laminated piezoelectric actuator.

Figure 13:
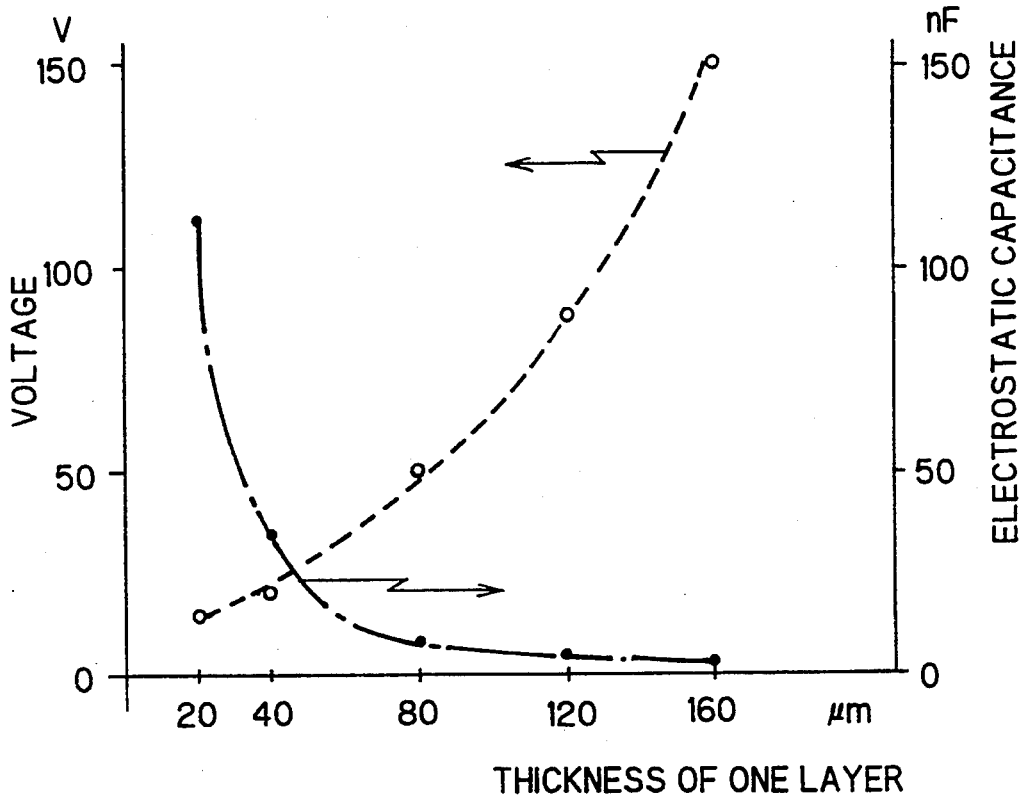
FIG. 13 is a graphical representation showing a relation of driving voltage and an electrostatic capacity with respect to a thickness of a piezoelectric layer.

Electrostatic capacitances in one driving portion of the LPA 111 are about 100, 35, 8.8, 3.9, and 2.2 nF with respect to five kinds of printer heads. The change of ink cavity volume required for ejecting ink droplets is about $3.37\times10^{-4}$ mm$^3$, and the driving voltage to this effect is about 16, 20, 50, 90 and 150 volts. FIG. 13 shows this relation. The reason that the driving voltage is extremely high for the thickness of 20 μm is that the dielectric constant of the piezoelectric material is low as the electrostatic capacitance C is represented by $C=\epsilon\cdot S/t$ as described previously.

Figure 14:
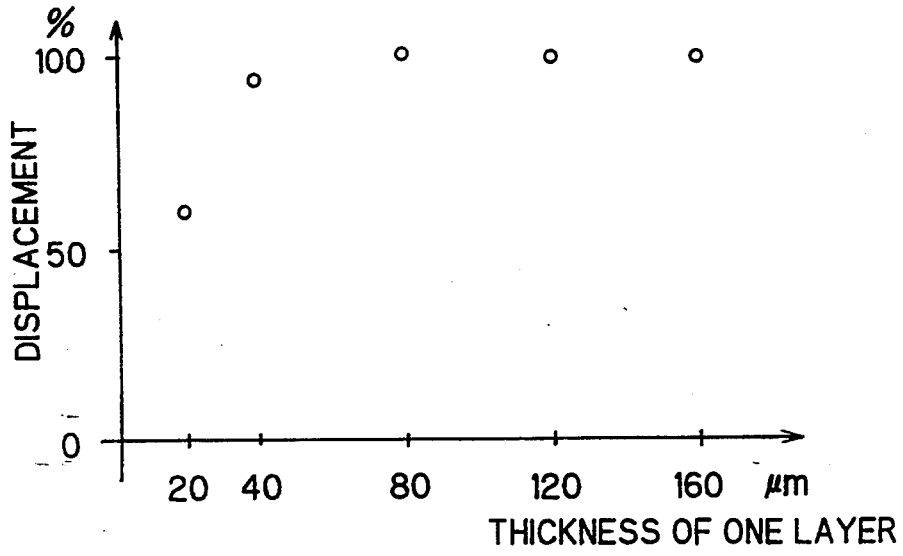
FIG. 14 is a graphical representation showing displacement of a piezoelectric layer per a unit strength of electrical field.

Large differences between theoretical values of the driving voltage and actual values of the driving voltage are also noted. To investigate the reason, a maximum displacement is measured upon applying D.C. 10 volts to each element. FIG. 14 is plotted while setting a theoretically obtained displacement per a unit strength of electric field strength as 100%. For more than 40 μm thickness of each piezoelectric ceramic layer, displacements are attained which are approximately equal to the theoretical values. Less displacement for the thickness of 20 μm can be made correspondence to the lowering of the dielectric constant.

Figure 15A:
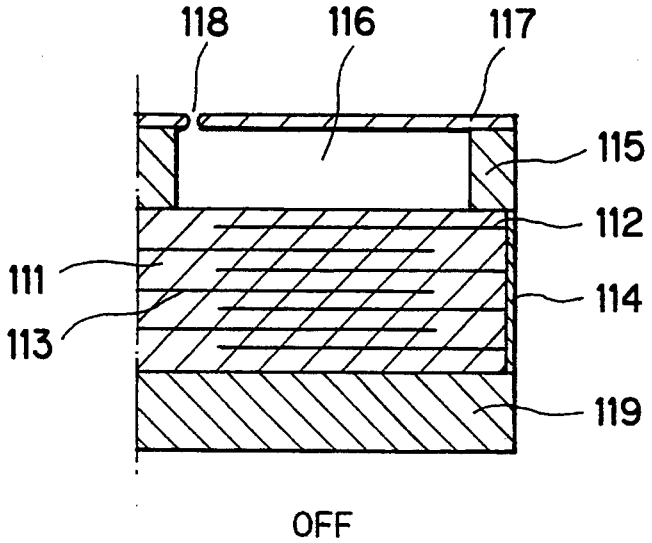
FIGS. 15(A) and 15(B) show diagrams indicating deformations of the piezoelectric layer.
Figure 15B:
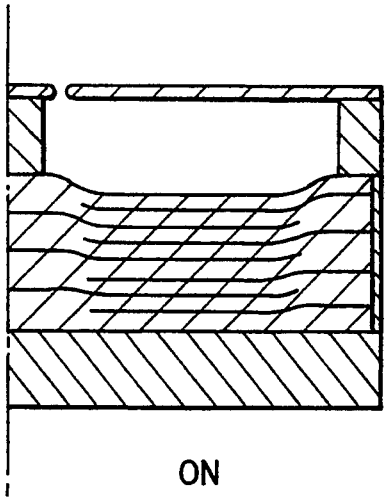
Figure 16:
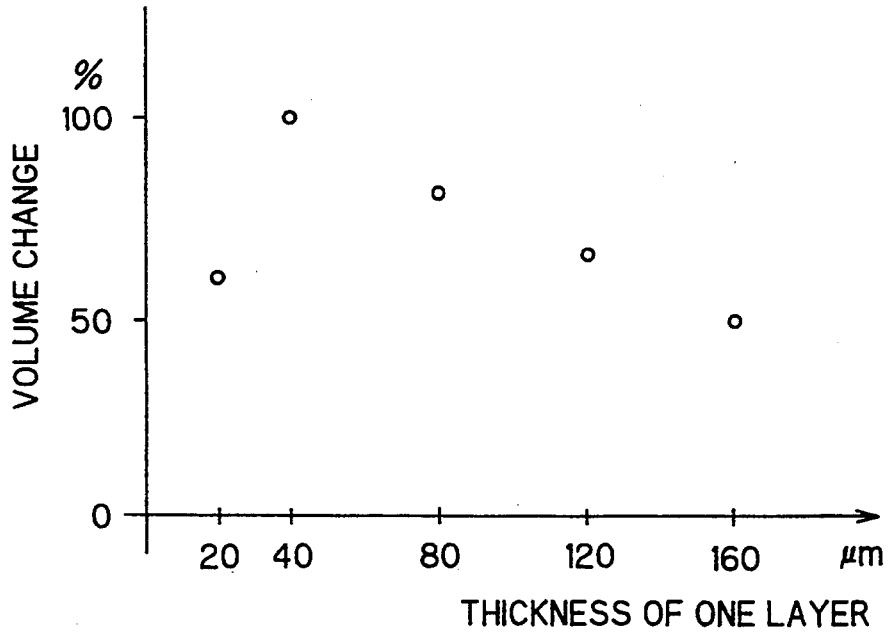
FIG. 16 is a graphical representation showing displacement of a piezoelectric layer per a unit strength of electrical field.

To investigate the efficiency of the local deformation, the change of volume per a unit strength of electric field is measured. FIG. 15 shows the results of the measurements. Setting the change of the volume for the 40 μm piezoelectric ceramic layer as 100%, the changes of the volume in various layer thickness are shown in FIG. 16. As can be seen from the data obtained, the deforming efficiency of the piezoelectric ceramic layer is lowered as the thickness thereof increases.

To change the volume of the ink cavity within about 2 μsec, the maximum instantaneous currents flowed at the time of discharge are 1900, 700, 438, 350, and 329 mA. When a discharge is carried out with the use of a transistor, it is desirable that the maximum instantaneous current be less than 1A in terms of the size and the cost of the transistor. Therefore, it is desirable that the thickness of each piezoelectric layer be above 40 μm. On the other hand, low voltage driving becomes difficult for more than 150 μm thick piezoelectric ceramic layer. To summarize, it is desirable that the thickness of each piezoelectric ceramic layer be in the range of 40 to 150 μm.

Referring to FIGS. 17 through 21, fourth to sixth embodiments of the present invention will be described.

Figure 17:
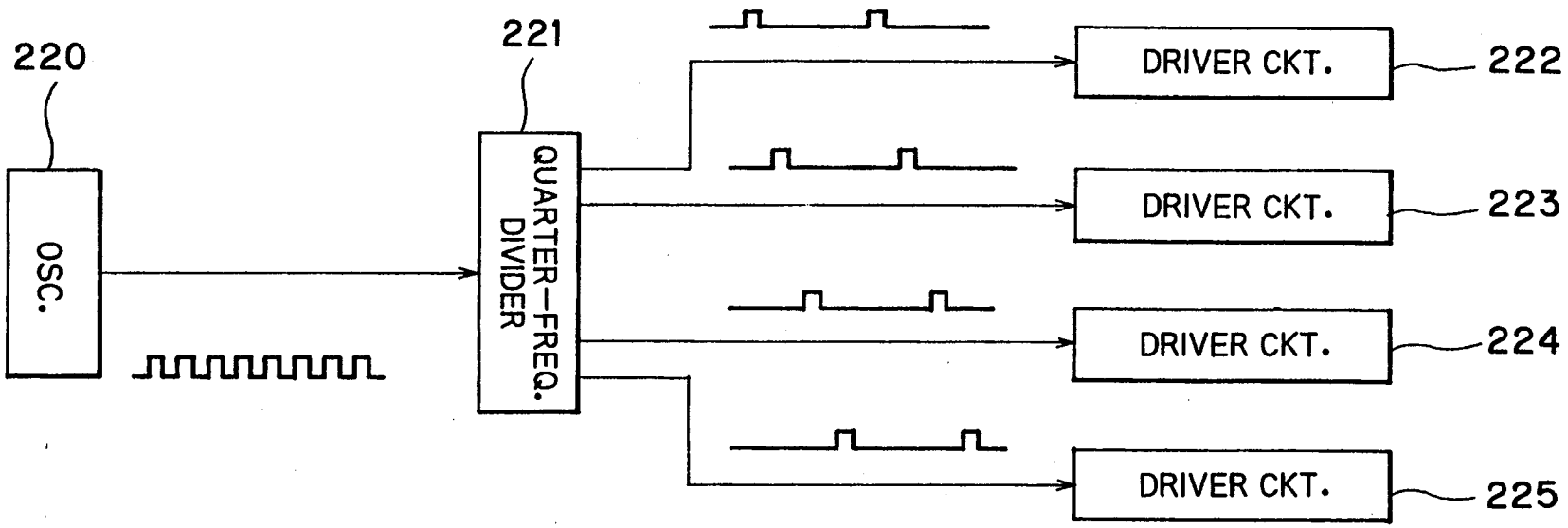
FIG. 17 is a block diagram showing a piezoelectric printer head according to a fourth embodiment of the present invention.

As shown in FIG. 17, an oscillator 220 is connected to a quarter-frequency divider 221 for frequency dividing the pulses produced from the oscillator 220. The quarter-frequency divider 221 is in turn connected to four driving circuits. Specifically, 64 driving portions are divided into four sets 222, 223, 224, 225 each including 16 driving portions, so that ejection timings of ink droplets are delayed by a quarter of a printing period. To drive the four driver circuits 222 through 225 within one printing period and to sequentially drive these circuits, the ink ejection timings are delayed every 25 μsec assuming that one print period has a duration of 100 μsec. An instantaneous maximum level of the current flowing in a single set of driving portions is about minus 7.5 amperes.

Figure 18:
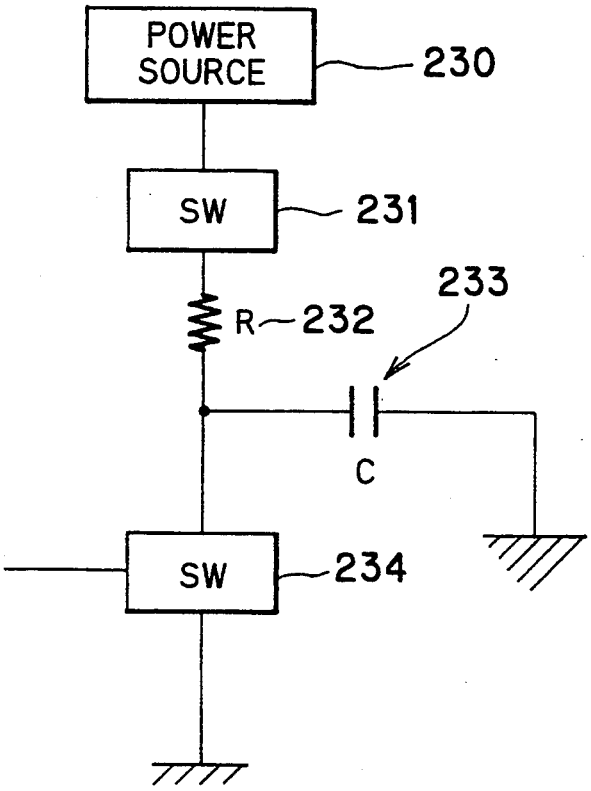
FIG. 18 is a block diagram showing a piezoelectric printer head according to a fifth embodiment of the present invention.

Another embodiment is shown in FIG. 18 in which a power source 230 is connected to one terminal of the piezoelectric element 233 through a discharge switch 231 and a resistor 232, and a discharge switch 234 is connected to the resistor 232 and the piezoelectric element 233. The embodiment shown in FIG. 18 is to slowly increase the ink volume. Ejection of the ink droplet occurs when the increased volume of the ink chamber restores to the original state upon discharging the accumulated electric charges. Since the time when the discharge occurs contributes to the ejection of the ink droplets, it is permitted to slowly increase the volume of the ink chamber. To prolong the rising time of the piezoelectric element causes to lower the level of the simultaneously flowing current.

Figure 19A:
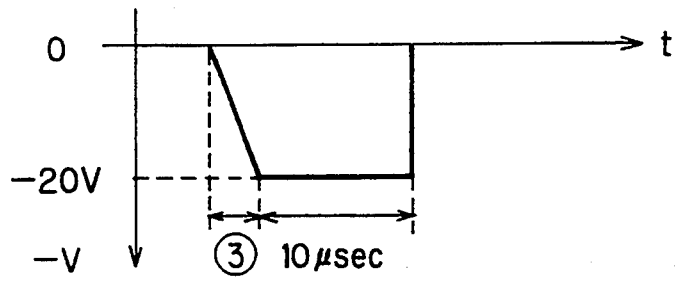
FIGS. 19(A) through 19(C) are waveform diagrams for description of the operation of the fifth embodiment of the present invention.
Figure 19B:
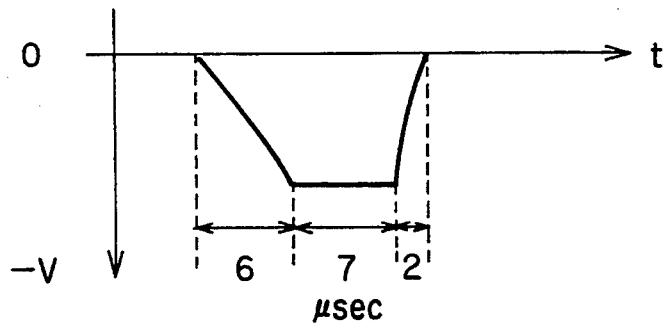

In operation, when the first switch 231 is rendered ON, an input voltage of minus 20 volts is applied from the power source 230 (see FIG. 19(A)), the piezoelectric element 233 is charged through the resistor 232 (see FIG. 19(B)). Thereafter, after expiration of a predetermined period of time (10 μsec), the first switch 231 is rendered OFF and the second switch 234 is rendered ON, whereby the electric charges accumulated in the piezoelectric element 233 is discharged (see FIG. 19(C)).

Under the condition where the rising time of the voltage to be developed across the piezoelectric element is 6 μsec, the voltage thereacross is maintained at minus 20 volts for a duration of 7 μsec, and 2 μsec is needed to zero the voltage thereacross, the maximum instantaneous level of the charging current flowed in each of the driving portion is about minus 235 mA and the maximum instantaneous level of the discharge current is about 700 mA. The maximum instantaneous current at the time of simultaneous ink ejection is minus 15 amperes.

Figure 20:
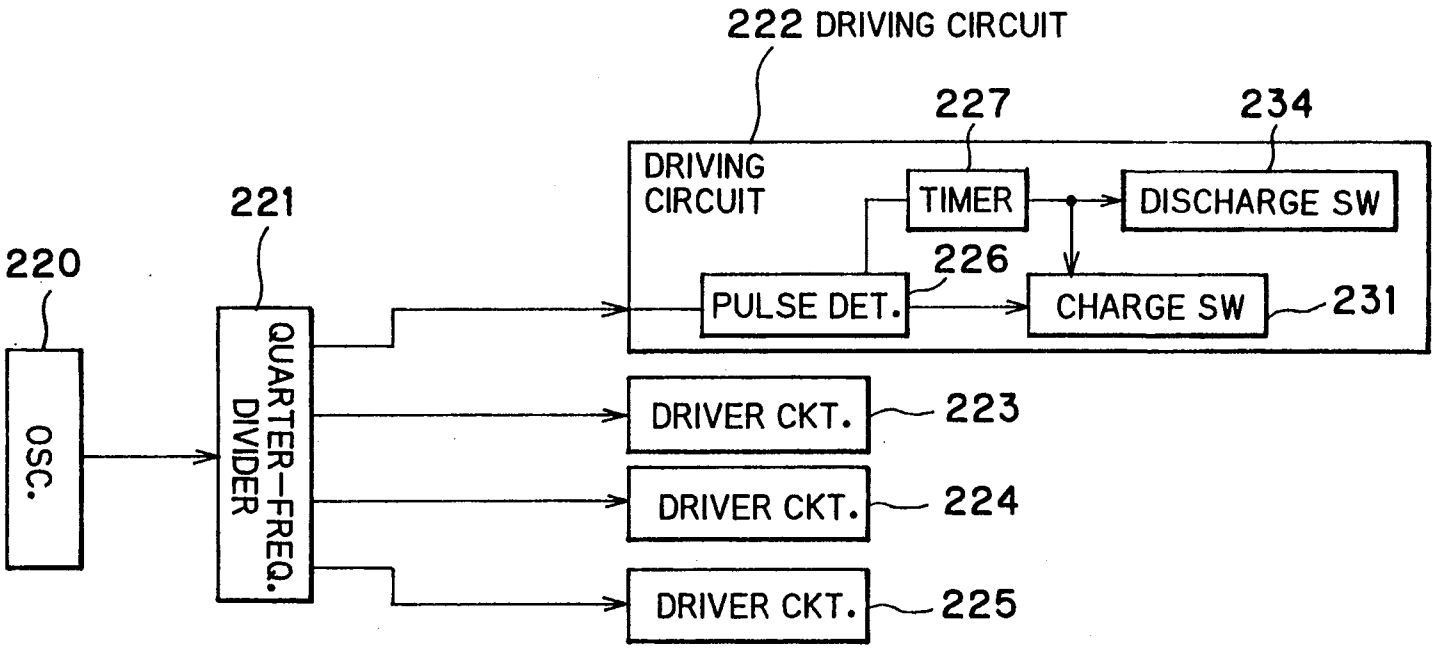
FIG. 20 is a block diagram showing a piezoelectric printer head according to a sixth embodiment of the present invention.

Still another embodiment of the invention will be described with reference to FIG. 20. The arrangement of this embodiment is a combination of the two embodiments described above. The same reference numerals used in FIGS. 17 and 18 denote the same components in FIG. 20.

64 driving portions are divided into four sets each including 16 driving portions which are allowed to be driven simultaneously. Ink ejection timings in each set of the driving portions are delayed within one printing period. The pulse produced from an oscillator 220 are subjected to frequency division into four by means of a quarter-frequency divider 221 and the frequency-divided pulses are fed to the four driving circuits 222, 223, 224, 225. The driving circuit 222 serves as a pulse detection circuit which includes a timer 227, a discharge switch 234, and a charge switch 231.

Figure 19C:
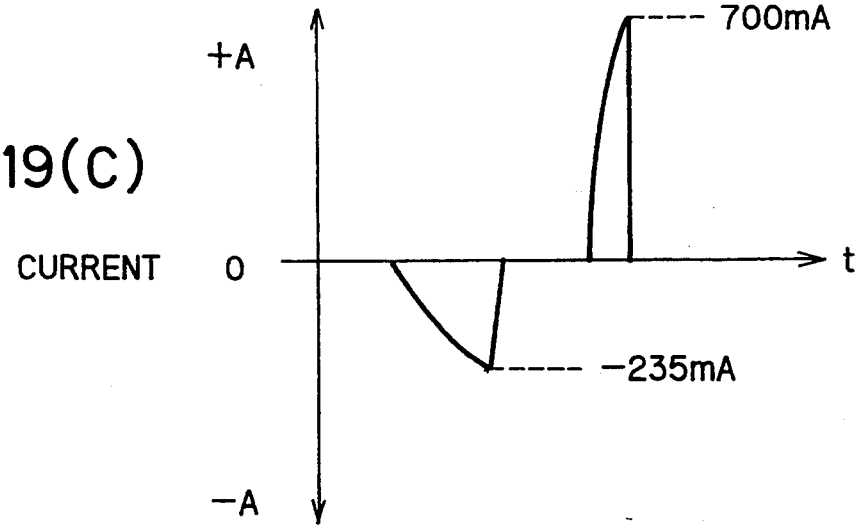

In operation, the pulses produced from the oscillator 220 is frequency-divided into four by the quarter-frequency divider 221, and the respective frequency-divided pulses are fed to the driver circuits 222 through 225. The pulses fed to the driver circuit 222 are applied to the pulse detection circuit 226, and the output of the pulse detection circuit 226 is in turn applied to the timer 227. The signals produced from the timer 227 are then applied to both the discharge switch 234 and the charge switch 231. More specifically, the timer 227 is activated in response to a pulse detected from the pulse detection circuit 226. Simultaneously therewith, the charge switch 231 is rendered ON. After expiration of a predetermined period of time, the charge switch 231 is rendered OFF whereas the discharge switch 34 is rendered ON, whereupon the waveforms of the input voltage and the voltage across the piezoelectric element are obtained as shown in FIG. 19(A) through 19(C).

In this embodiment, the delay time for each driver circuit is set to about 25 μsec. As in the previously described embodiment, the rise time up to minus 20 volts is 6 μsec, the duration of maintaining minus 20 volts is 7 μsec, and the voltage lowering time up to 0 volt is 2 μsec. The maximum level of the instantaneously flowing current is about minus 235 mA per one driving portion, the maximum level of the discharge current is about 700 mA, and the maximum level of the instantaneous current at the time when the ink droplets are simultaneously ejected is about minus 3.8 A.

As a result, the required capacity of the power source is about 76 VA. In the above-described three embodiments, the maximum level of the instantaneously flowing current into the individual driving portion is remained the same, i.e., 700 mA, because it is essential that the deformation of the driving portion be taken place simultaneously so as to eject ink droplet and the ejection of the ink droplet is performed at the time when the piezoelectric element is deformed at the time of discharge. To allow the simultaneous discharge to be taken place, a discharge transistor can be used for each of 64 driving portions. For a current of 700 mA, such transistors can be mounted on the surface of the piezoelectric element.

Although the present invention has been described with respect to specific embodiments, it will be appreciated by one skilled in the art that a variety of changes may be made without departing from the scop of the invention. For example, certain features may be used independently of others and equivalents may be substituted all within the spirit and scope of the invention.

What is claimed is:

1. A printing head for a piezoelectric ink jet printer, comprising:

a plurality of ejector devices juxtaposed along a line extending in a first direction for ejecting ink droplets in a second direction perpendicular to the first direction, each of said ejector devices having an ink channel body defining an ink channel having an inner volume; and a piezoelectric actuator secured to each ink channel body of said ejector devices for actuating each of said ejector devices by changing the inner volume of an associated ink channel independently of one another, said actuator comprising a plurality of piezoelectric ceramic layers polarized in the second direction, a plurality of internal positive electrode layers, and a plurality of internal negative electrode layers, which are laminated in such a manner that a piezoelectric ceramic layer is sandwiched between an internal positive electrode layer and an internal negative electrode layer, at least one of said internal positive electrode layers and said internal negative electrode layers being divided into a plurality of segments with each of said segments being in a one to one correspondence with a respective ink channel of said plurality of ejector devices, wherein the ink channel has a width in the first direction no smaller than a width of an associated segmental electrode layer in the first direction and wherein each of said plurality of piezoelectric ceramic layers is in a form of a single plate.

2. The printing head according to claim 1, wherein said piezoelectric ceramic layer is formed of ceramic material of lead zirconate titanate group having ferroelectricity.

3. The printing head according to claim 1, wherein said piezoelectric ceramic layer is polarized in the second direction.

4. The printing head according to claim 1, further comprising deformation restraining means secured to said piezoelectric actuator on a side opposite to said ejector devices for restraining deformation of said piezoelectric actuator which may otherwise deform in a direction opposite to the second direction when a voltage is applied between the positive and negative electrode layers.

5. The printing head according to claim 1, wherein each piezoelectric ceramic layer has a thickness in a range of from 40 μm to 150 μm.

6. The printing head according to claim 4, wherein each piezoelectric ceramic layer has a thickness in a range of from 40 μm to 150 μm.

7. A printing head in accordance with claim 1 wherein a selected one of said internal positive electrode layers and said internal negative electrode layers is divided into a plurality of segments and a non-selected one of said internal positive electrode layers and said internal negative electrode layers is in a form of a single plate.

8. A printing head for a piezoelectric ink jet printer, comprising:

a plurality of ejector devices juxtaposed along a line extending in a first direction for ejecting ink droplets in a second direction perpendicular to the first direction, each said ejector devices having an ink channel body defining an ink channel having an inner volume; and a piezoelectric actuator secured to the ink channel body of each of said ejector devices for actuating each of said ejector devices by changing the inner volume of an associated ink channel independently of one another, said actuator comprising a plurality of piezoelectric ceramic layers polarized in the second direction, a plurality of internal positive electrode layers, a plurality of internal negative electrode layers, and a deformation restraining member secured to said piezoelectric actuator on a side opposite to said ejector devices for restraining deformation of said piezoelectric actuator which may otherwise deform in a direction opposite to the second direction, said piezoelectric ceramic layers, said positive electrode layers, and negative electrode layers being laminated in such a manner that each piezoelectric ceramic layer is sandwiched between an internal positive electrode layer and an internal negative electrode layer, at least one of said internal positive electrode layers and said internal negative electrode layers being divided into a plurality of segments with each of said segments being in a one to one correspondence with a respective ink channel of said plurality of ejector devices and wherein each of said plurality of piezoelectric ceramic layers is in a form of a single plate.

9. The printing head according to claim 8, wherein said deformation restraining member comprises a metal plate of high mudulus of elasticity.

10. The printing head according to claim 8, wherein said deformation restraining member comprises a plate of ceramic.

11. The printing head according to claim 8, wherein each piezoelectric ceramic layer has a thickness in a range of from 40 μm to 150 μm.

12. A printing head for a piezoelectric ink jet printer, comprising:

a plurality of ejector devices juxtaposed along a line extending in a first direction for ejecting ink droplets in a second direction perpendicular to the first direction, each said ejector devices having an ink channel body defining an ink channel having an inner volume; and a piezoelectric actuator secure to each ink channel body of said ejector devices for actuating each of said ejector devices by changing the inner volume of the associated ink channel independently of one another, said actuator comprising a plurality of piezoelectric ceramic layers polarized in the second direction, a plurality of internal positive electrode layers, and a plurality of internal negative electrode layers, which are laminated in such a manner that each piezoelectric ceramic layer is sandwiched between an internal positive electrode layer and an internal negative electrode layer, at least one of said internal positive electrode layers and said internal negative electrode layers being divided into a plurality of segments with each of said segments being in a one to one correspondence with a respective ink channel of said plurality of ejector devices, wherein each of said piezoelectric ceramic layers has a thickness in a range of from 40 μm to 150 μm and wherein each of said plurality of piezoelectric ceramic layers is in a form of a single plate.

13. A printing head for a piezoelectric ink jet printer, comprising:

a plurality of ejector devices juxtaposed along a line extending in a first direction for ejecting ink droplets in a second direction perpendicular to the first direction, each said ejector devices having an ink channel body defining an ink channel having an inner volume;

a piezoelectric actuator secured to each ink channel body of said ejector devices for actuating each of said ejector devices by changing the inner volume of an associated ink channel independently of one another, said actuator comprising a plurality of piezoelectric ceramic layers polarized in the second direction, a plurality of internal positive electrode layers, and a plurality of internal negative electrode layers, said actuator being formed with a plurality of active regions corresponding to a respective ink channel, said active regions having a laminated structure such that a piezoelectric ceramic layer is sandwiched between an internal positive electrode layer and an internal negative electrode layer, each of said plurality of active regions being deformed when a driving voltage is applied between the associated internal positive electrode layer and internal negative electrode layer to cause ink contained in the associated ink channel to eject in the second direction, at least one of said internal positive electrode layers and said internal negative electrode layers being divided into a plurality of segments with each of said segments being in a one to one correspondence with a respective ink channel of said plurality of ejector devices;

an oscillator for producing a driving signal having a predetermined frequency;

frequency dividing means for frequency-dividing the driving signal to produce at least two sets of frequency divided driving signals; and a plurality of driving means provided corresponding to a number of sets of frequency-divided driving signals, for sequentially driving said active regions on a group basis in accordance with each of the frequency-divided driving signals at a given timing within a time defined by a printing period, wherein said plurality of active regions are divided into a plurality of groups corresponding to said plurality of driving means, each of said plurality of driving means comprising pulse detection means for detecting a predetermined frequency-divided signal produced from said frequency dividing means; time setting means for setting times for charging and discharging the corresponding piezoelectric ceramic layer in accordance with the frequency-divided signal detected by said detection means; first switching means for charging said piezoelectric ceramic layer during a period of charging time set by said time setting means; and second switching means for discharging said piezoelectric ceramic layer during a period of discharging time set by said time setting means.

14. A printing head for a piezoelectric ink jet printer, comprising:

a power supply for supplying a predetermined voltage;

a plurality of ejector devices juxtaposed along a line extending in a first direction for ejecting ink droplets in a second direction perpendicular to the first direction, each said ejector devices having an ink channel body defining an ink channel having an inner volume;

a piezoelectric actuator secured to each ink channel body of said ejector devices for actuating each of said ejector devices by changing the inner volume of an associated ink channel independently of one another, said actuator comprising a plurality of piezoelectric ceramic layers polarized in the second direction, a plurality of internal positive electrode layers, and a plurality of internal negative electrode layers, said actuator being formed with a plurality of active regions corresponding to a respective ink channel, said active regions having a laminated structure such that a piezoelectric ceramic layer is sandwiched between an internal positive electrode layer and an internal negative electrode layer, each of said plurality of active regions being deformed when a driving voltage is applied between the associated internal positive electrode layer and internal negative electrode layer to cause ink contained in the associated ink channel to eject in the second direction, at least one of said internal positive electrode layers and said internal negative electrode layers being divided into a plurality of segments so as to be provided in association with respective ones of said plurality of ejector devices wherein each of said plurality of piezoelectric ceramic layers is in a form of a single plate;

first switching means for charging said piezoelectric layer having a first terminal connected to said power source and a second terminal;

a resistor having a first terminal connected to said second terminal of said first switching means and a second terminal connected to said piezoelectric ceramic layer in each of said plurality of active regions; and second switching means having a terminal connected to both said second terminal of said resistor and said piezoelectric ceramic layer, for discharging electric charges accumulated in said piezoelectric ceramic layer.

* * * * *